US006516626B2

(12) United States Patent
Escobar et al.

(10) Patent No.: US 6,516,626 B2
(45) Date of Patent: Feb. 11, 2003

(54) TWO-STAGE REFRIGERATION SYSTEM

(75) Inventors: Jeffrey Grant Escobar, Kirkland, WA (US); Jon Almon Hocker, Bothell, WA (US); Håkan Ohlsson, Furulund (SE); John Richard Strong, Kirkland, WA (US)

(73) Assignee: FMC Corporation, Chicago, IL (US)

( * ) Notice: Subject to any disclaimer, the term of this patent is extended or adjusted under 35 U.S.C. 154(b) by 77 days.

(21) Appl. No.: 09/833,304

(22) Filed: Apr. 11, 2001

(65) Prior Publication Data

US 2002/0148246 A1 Oct. 17, 2002

(51) Int. Cl.[7] ..... F25D 17/02
(52) U.S. Cl. ..... 62/434
(58) Field of Search ..... 62/54.1, 114, 332, 62/333, 502, 515, 434

(56) References Cited

U.S. PATENT DOCUMENTS

| | | | |
|---|---|---|---|
| 3,558,731 | A | 1/1971 | Young |
| 3,757,367 | A | 9/1973 | Campbell |
| 3,767,724 | A | 10/1973 | Gouw |
| 3,788,091 | A | 1/1974 | Miller |
| 3,819,278 | A | 6/1974 | Muller |
| 3,869,870 | A | 3/1975 | Kuehner |
| 3,870,417 | A | 3/1975 | Bashark |
| 3,872,682 | A | 3/1975 | Shook |
| 3,906,742 | A | 9/1975 | Newton |
| 4,224,801 | A | 9/1980 | Tyree, Jr. |
| 4,444,023 | A | 4/1984 | Barbini et al. |
| 4,640,099 | A | 2/1987 | Gibot |
| 4,690,210 | A | 9/1987 | Niggemann et al. |
| 5,092,133 | A | 3/1992 | Franklin |
| 5,104,232 | A | 4/1992 | Lennox, III |
| 5,121,611 | A | 6/1992 | Broderdorf et al. |
| 5,343,715 | A | 9/1994 | Lang |
| 5,475,487 | A | 12/1995 | Mariella, Jr. et al. |
| 5,715,702 | A | 2/1998 | Strong et al. |
| 5,960,411 | A | 9/1999 | Hartman |

FOREIGN PATENT DOCUMENTS

| | | |
|---|---|---|
| DE | 30 04 114 | 11/1980 |

*Primary Examiner*—William C. Doerrler
*Assistant Examiner*—Malik N. Drake
(74) *Attorney, Agent, or Firm*—Christensen O'Connor Johnson Kindness pllc

(57) ABSTRACT

A two-stage refrigeration system includes an intermediate slurry tank for receiving and storing a refrigerant vapor and a slurry of solid sublimatable refrigerant particles in a liquid. The intermediate slurry tank has a first outlet for outflow of the slurry from the tank, a second outlet for outflow of the refrigerant vapor, a first inlet for receiving at least the liquid, and a second inlet for receiving the refrigerant. The refrigeration system also includes a compression system having a first low pressure inlet and second intermediate pressure inlet, and having a high pressure outlet. A conduit connects the second outlet of the intermediate slurry tank to the intermediate pressure inlet of the compression system so as to compress the vapor with less energy than would be needed to compress low pressure refrigerant vapor.

70 Claims, 6 Drawing Sheets

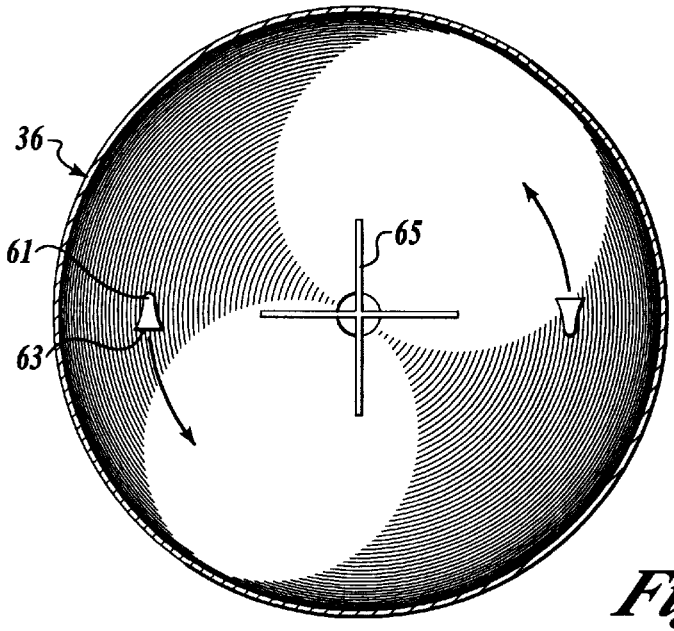
Fig. 9.
Fig. 8.
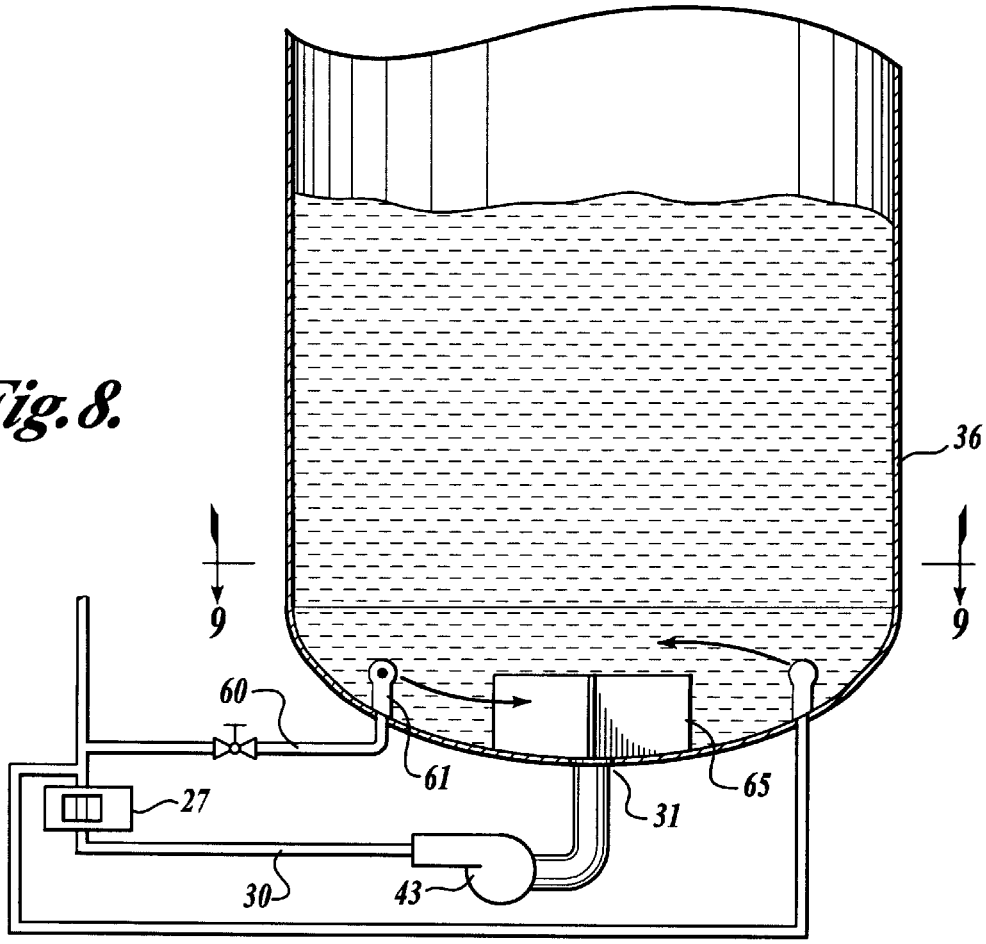

TWO-STAGE REFRIGERATION SYSTEM

FIELD OF THE INVENTION

The present invention relates to a refrigeration system. More particularly the invention relates to an extremely low temperature two-stage refrigeration system capable of utilizing refrigerant vapor and a slurry of solid sublimatable refrigerant particles in a liquid.

BACKGROUND OF THE INVENTION

U.S. Pat. No. 5,715,702 to Strong et al. (hereinafter Strong) describes a refrigeration system using a slurry of solid refrigerant particles of a first substance and a liquid of a second substance. More particularly, Strong, discloses a system with a mixing tank for supplying a slurry of solid, sublimatable particles in a liquid to a sublimator. The sublimator returns sublimated particles and remainder slurry to a separator. The separator returns slurry to the mixing tank and sends the sublimated particles to a compressor and condenser. The condenser returns liquid refrigerant to the mixing tank for a new cooling cycle.

Referring to FIGS. 1 and 2, illustrating the prior art refrigeration system of Strong, the figure numbering convention will include a (') to indicate that it is a feature of the prior art. The refrigeration system of Strong discloses a mixing tank 37', separator 36', an evaporator 3', compressor 10', a condenser 15', and a receiver 16', for use with a slurry of solid sublimatable particles in a liquid. The mixing tank 37' has a first outlet 5', second outlet 34', a first inlet 31', and a second inlet 17'. The evaporator 3' has an inlet 6' and an outlet 8'. A first conduit 4' connects the first mixing tank outlet 5' to the inlet of the evaporator 6'. The separator 36' has a first inlet 9', first outlet 31', and second outlet 12'. A second conduit 7' connects the evaporator outlet 8' to the first separator inlet 9'. The separator 36' discharges directly to the mixing tank 37' by the shared opening separator first outlet 31' and first inlet of the mixing tank 31'. A pipe 34' and pressure regulator 35' transfers vapor between the mixing tank 37' and the separator 36'. The compressor 10' has an inlet 11' and an outlet 14' and is connected to a condenser 15' followed by the receiver 16'. A third conduit 13' connects the second outlet of the separator 12' to the compressor inlet 11'. A fourth conduit 19' connects the receiver to the second inlet of the mixing tank 17'.

One of the problems with Strong, that the present invention seeks to solve, includes the potential plugging of the system due to the particles of refrigerant clogging or freezing shut conduits, valves, or inlets and outlets. Another problem is the energy requirements for this system are very high. The present invention has several improvements for addressing the potential system plugging, and also for significantly reduces the energy requirements of the system.

SUMMARY OF THE INVENTION

The present invention provides a refrigeration system for use with a refrigerant vapor and a slurry of solid sublimatable refrigerant particles in a liquid, where the refrigerant used in conjunction with the invention is preferably carbon dioxide ($CO_2$) and the liquid is preferably d'limonene.

In a first embodiment of the present invention the intermediate slurry tank receives and stores $CO_2$ vapor as well as a slurry of $CO_2$ particles in the d'limonene liquid. The intermediate slurry tank is preferably maintained below the triple point of $CO_2$. The intermediate slurry tank sends the slurry to the evaporator, the slurry being fed through a pump or by utilizing pressure and/or gravity from the intermediate slurry tank. A main slurry tank receives and stores the discharge from evaporator. The main slurry tank sends the remaining slurry back to the intermediate slurry tank, and sends the vapor $CO_2$ to the compression system. The compression system also receives vapor $CO_2$ from the intermediate slurry vessel, compresses the vapor from the main slurry tank and intermediate slurry tank and send it to the condenser. The condenser sends the condensate to the condenser receiving tank. The condenser receiving tank stores the liquid $CO_2$ condensate and is maintained at a higher pressure than the intermediate slurry tank. The condenser receiving tank sends the liquid $CO_2$ back to the intermediate slurry tank. The liquid $CO_2$ is expanded either on its way to the intermediate slurry tank or in the tank itself. The expansion causes solid particles of $CO_2$ to form from the liquid $CO_2$. These solid $CO_2$ particles are mixed into the slurry in intermediate slurry tank. The expansion of the liquid $CO_2$ also results in vapor $CO_2$ being produced.

In a further aspect of the present invention the conduit from the condenser receiving tank to the intermediate slurry tank may be modified to reduce refrigerant particle size as well as reducing the risk of plugging of the conduit or freezing of a valve in the conduit. The modifications may include: sloping the conduit, placing the point of refrigerant expansion close to the intermediate slurry tank, feeding gas into the system to add turbulence or heat, a special valve seat which forces the pressure drop to occur down stream of an expansion valve, or a direct injection system 200 to place the liquid refrigerant discharge directly into the intermediate slurry tank.

In a another aspect of the present invention a special slurry recirculation line is detailed. The recirculation line is designed to sweep the solid refrigerant particles off of a tank bottom to keep them suspended in the slurry.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein:

FIG. 8 illustrates a cross sectional view taken from the vertical plane of a refrigeration recirculation line according to a further aspect of the present invention; and FIG. 9 illustrates a cross sectional view taken from the horizontal plane of a refrigeration recirculation line according to a further aspect of the present invention.

DETAILED DESCRIPTION OF THE PREFERRED EMBODIMENT

A refrigeration system is described. In the following description, for purposes of explanation, numerous specific details are set forth in order to provide a thorough understanding of the invention. It will be apparent, however, to one skilled in the art that the invention can be practices without these specific details.

Reference in the specification to "one embodiment" or "an embodiment" means that a particular feature, structure, or characteristic described in connection with the embodiment is included in at least one embodiment of the invention. The appearance of the phrase "in one embodiment" in various places in the specification are not necessarily referring to the same embodiment.

Figure 3:
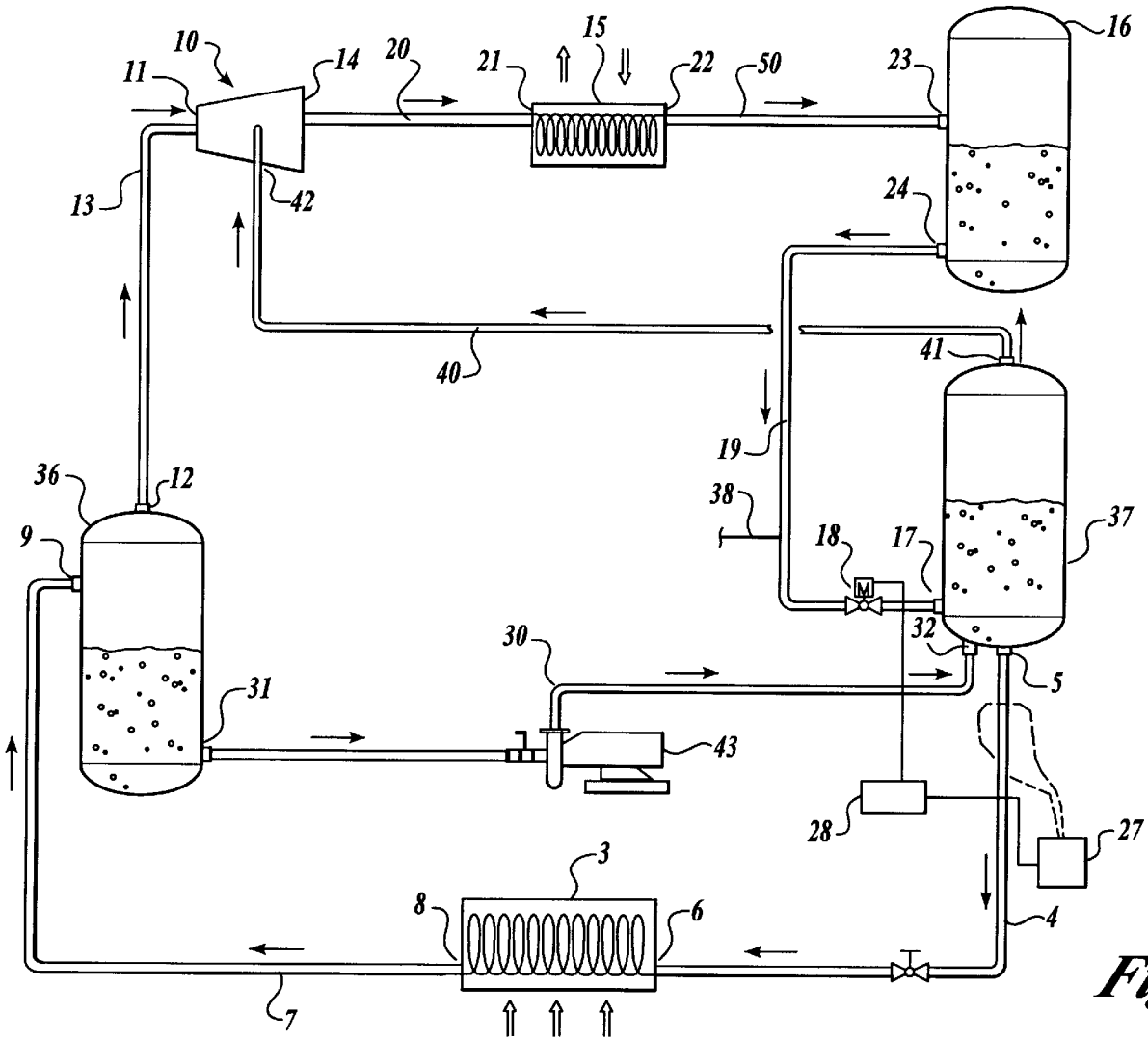
FIG. 3 illustrates one embodiment of a refrigeration system according to the present invention.

Referring to FIG. 3, the present invention has some design similarities to the prior art of Strong, but the present invention has several improvements and advantages over the prior art. The present invention can include an intermediate slurry tank 37 for receiving and storing a refrigerant vapor and a slurry of solid sublimatable refrigerant particles in a liquid. The intermediate slurry tank 37 has a first lower outlet 5 for outflow of the slurry within the slurry tank, a second upper outlet 41 for outflow of the refrigerant vapor in the tank, a first inlet 32 for receiving at least the liquid, and a second inlet 17 for receiving the refrigerant. An evaporator 3 has an inlet 6 for receiving slurry and an outlet 8 for outflow of refrigerant and liquid, where a conduit 4 connects the first outlet of the intermediate slurry tank 5 and the evaporator inlet 6. A main slurry tank 36 receives and stores at least the refrigerant vapor and the liquid. The main slurry tank 36 has a first lower outlet 31 for outflow of at least the liquid, a second upper outlet 12 for outflow of the refrigerant vapor, and an inlet 9, where a conduit 7 connects the evaporator outlet 8 and the main slurry tank inlet 9. A conduit 30 connects the first outlet of the main slurry tank 31 with the first inlet of the intermediate slurry tank 32.

A compression system 10 has a first low pressure inlet 11 and second intermediate pressure inlet 42. The compression system 10 also has a high pressure outlet 14, where a conduit 13 connects the second outlet of the main slurry tank 12 and the low pressure inlet of the compression system 11. A conduit 40 connects the second outlet of the intermediate slurry tank 41 and the intermediate pressure inlet of the compression system 42. A condenser 15 has a condenser inlet 21 and a condenser outlet 22. A conduit 20 connects the compression system outlet 14 and the condenser inlet 21. A condenser receiving tank 16 has an upper inlet 23 for receiving refrigerant from the condenser and a lower outlet 24 for outflow of refrigerant. A conduit 50 connects the condenser outlet 22 and the condenser receiving tank inlet 23. A conduit 19 connects the condenser receiving tank outlet 24 to the second intermediate slurry tank inlet 17.

The refrigerant and liquid for use in conjunction with the present invention may be composed of several substances. The refrigerant must be immiscible in the liquid at a given temperature and pressure. The refrigerant must also be capable of sublimating at a temperature and pressure appropriate for refrigeration, while the liquid remains in liquid form at this temperature and pressure. Any substances with corresponding properties could be used. In one embodiment the refrigerant can be carbon dioxide ($CO_2$) and the liquid is d'limonene; however, the invention is not limited to this embodiment.

Referring again to FIG. 3, in one embodiment of the present invention, the refrigerant used in conjunction with the invention can be carbon dioxide ($CO_2$) and the liquid can be d'limonene, the intermediate slurry tank 37 receives and stores $CO_2$ vapor as well as a slurry of $CO_2$, particles in the d'limonene liquid. The intermediate slurry tank is preferably maintained below the triple point of $CO_2$. For example, the tank 37 can be maintained at −72° F. and at 70 psia. The intermediate slurry tank 37 sends the slurry to the evaporator 3, the slurry being fed through a pump or by utilizing pressure and/or gravity from the intermediate slurry tank 37. A main slurry tank 36 receives and stores the discharge from evaporator 3, and may typically be maintained at 15 psia. The discharge from the evaporator 3 is typically of slurry and $CO_2$ vapor, but could be only slurry, or could be only liquid d'limonene and $CO_2$ vapor. The main slurry tank sends the slurry back to the intermediate slurry tank 37, and sends the vapor to the compression system 10. The compression system 10 also receives vapor from the intermediate slurry vessel, compresses the vapor from the main slurry tank 36 and intermediate slurry tank 37 and send it to the condenser 15. The condenser 15 sends the condensate to the condenser receiving tank 16. The condenser receiving tank 16 stores the liquid $CO_2$ condensate and may typically maintained at −12° F. and at 250 psia. The condenser receiving tank sends the liquid $CO_2$ back to the intermediate slurry tank 37. The liquid $CO_2$ is expanded either on its way to the intermediate slurry tank 37 or in the tank itself. The expansion causes solid particles of $CO_2$ to form from the liquid $CO_2$. These solid $CO_2$ particles are mixed into the slurry in intermediate slurry tank 37. The expansion of the liquid $CO_2$ also results in vapor $CO_2$ being produced. This vapor $CO_2$ is separated in the intermediate slurry tank 37, and as stated previously returned to the compression system 10.

The mixing tank 1' of the prior art of Strong has a pipe 34' with a pressure regulator 35' to transfer vapor between the mixing tank 37' and the separator 36'. Unlike Strong, the present invention includes a fifth conduit 40 from the intermediate slurry tank 37, to a compression system 10. This greatly improves the efficiency of the refrigeration system. The liquid from the condenser receiving tank 16 is expanded to just below the triple point (about 72 psia for $CO_2$) and stored in the intermediate slurry tank 37. The expansion produces flash gas. This flash gas is separated from the slurry in the intermediate slurry tank 37 by gravity and/or centrifugal forces. The separated flash gas can be returned to the compression system 10 for compression. It takes far less energy to compress the flash gas from this pressure than from the low pressure of the gas returning from the main slurry tank 36. Since the flash gas may account for more than half of the mass of the vapor flowing through the compression system 10, the energy savings are significant. The energy gains are greatest at sublimation temperatures well below the triple point. Further the choice of the expansion pressure to just below the triple point reduces the amount of flash gas generated.

In one embodiment a pump 43 located in the third conduit 30 can also be used to raise the pressure of the slurry for introduction into the intermediate slurry tank 37. The level control of the main slurry tank 36 may also be accomplished by placing a frequency inverter on the pump 43. Unlike the pipe 34' with a pressure regulator 35' described by the prior art of Strong, the present invention provides for a pressure differential to be maintained between the main slurry tank and the intermediate slurry tank with the use of a pump 43 located in the third conduit 30. The prior art of Strong describes the use of the pressure regulator 35' as useful for equalizing the pressure between the mixing tank 37' and the separator 36', or for maintaining a pressure difference between the two. Strong notes, however, that this pressure difference is limited, and must not be greater than the pressure from the column of slurry coming out of separator outlet 31'. The goal noted in Strong is to supply pressure to move the slurry from the separator 36' to the mixing tank 37'. In the present invention, the pump 43 is provided, and there is no equivalent device in Strong. The pump may not only be provided to move slurry from the main slurry tank to the intermediate slurry tank 37, but also may be provided to create and maintain the pressure in the intermediate slurry tank 37 below the triple point of the refrigerant.

In another aspect of the invention, the compression system 10 of the present invention may be of various arrangements. The compression system may comprise a main compressor with a side port for receiving the flash gasses. Alternatively multiple compressors may be used with a separate intermediate compressor for the flash gasses. If the side port of the main compressor cannot handle the mass flow of vapor, a two stage compression system, with the interstage pressure being the pressure of the intermediate slurry tank is an optional embodiment.

In a further aspect of the invention, the slurry from the intermediate pressure tank 37 may be sent to the evaporator 3 using the pressure supplied by the expanded flash gas, without the need for further pumping. An orifice or control valve at the evaporator 3 can regulate the flow of slurry into the evaporator.

In one embodiment the main tank 36 is smaller than the intermediate slurry tank 37, so that the intermediate slurry tank may accommodate variations in slurry volume. The slurry in the main tank 36 may then be maintained at a relatively low constant level. This provides several advantages. The intermediate slurry tank 37 will be large enough to accommodate splashing from the addition of refrigerant from the condenser receiving tank 16. The large volume of slurry in the intermediate slurry tank 37 can be stirred by the addition of refrigerant from the condenser receiving tank 16. In an alternative embodiment, the size of the main slurry tank 37 will also need to be minimized so that it may be located at the freezer itself. Location at the freezer may not be possible if the main slurry tank 36 is too large.

Expansion Conduit

Referring to FIG. 3, in a further aspect of the present invention, the conduit 19 may further comprise a valve 18 to control the flow of refrigerant through the conduit. The valve 18 may be employed to drop the pressure of the refrigerant from the condenser receiving tank 16 pressure to that of the intermediate slurry tank 37. As noted above, in the present invention, liquid refrigerant is expanded during transfer to the intermediate slurry tank 37. This expansion may cause several problems. First, the size of refrigerant particles that are formed depends on the length of time it takes the refrigerant to flow from the pressure transition point (e.g. valve 18) to the intermediate slurry tank 37. The longer time this pressure transition exists, the larger the refrigerant particles become. For the present invention it is desirable to keep the refrigerant particles small to increase the surface area to mass ratio, for refrigeration efficiency as well as improved suspension in slurry. In one embodiment the valve 18 is placed close to the intermediate slurry tank 37 to decrease the size of solid refrigerant particles deposited into the intermediate slurry tank 37. Alternatively or in addition, the conduit 19 should be as straight as possible to avoid small areas of greater refrigerant residency, which may cause solid refrigerant to form partial or complete blockage of the conduit.

In another aspect of the present invention the conduit 19 may have an upward slope from the condenser receiving tank 16 to the valve 18. This upward slope minimizes the amount of fluid in contact with the valve 18 when it is shut, which in turn minimizes the risks of the valve 18 freezing shut. An alternative embodiment is to have no slope or downward slope to the conduit 19 and a small trap just before the valve 18 to create a gas pocket when the valve 18 is closed. In another feature of this aspect of the invention, the conduit 19 may have a downward slope from the valve 18 to the intermediate slurry tank 37. Like the upward conduit slope noted above, this downward slope minimizes the amount of fluid in contact with the valve 18 when it is shut, which minimizes the risks of the valve 18 freezing shut.

A further aspect of the present invention is to trickle feed gas into the conduit 19 before the valve 18. The trickle feed gas may be supplied to the system by conduit 37 placed in fluid flow communication with conduit 19. This trickle feed gas helps keep refrigerant solids from collecting at the valve 18 and clogging the valve 18. The trickle feed gas also assists in stirring the refrigerant. If the valve 18 does freeze, hot gas may be fed into the conduit 19, as a vapor de-plug feed, just upstream of the valve 18 to remove the plug solids at the valve 18. In one embodiment either the trickle feed gas and/or the vapor de-plug vapor may be $CO_2$. In one embodiment the trickle feed gas may be supplied from the compression system 10 discharge.

Expansion Valve Seat

Figure 1:
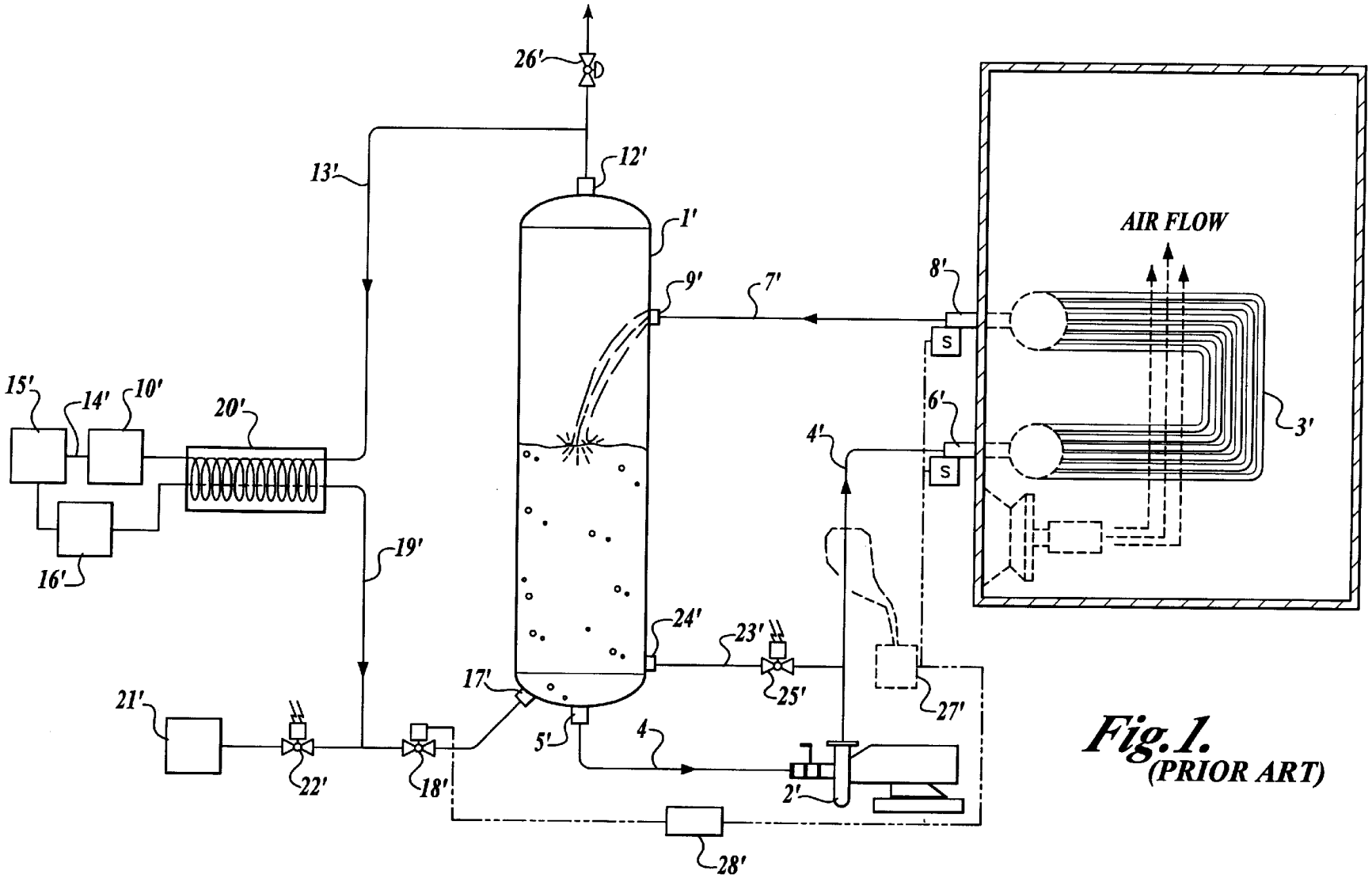
Fig. 1. (PRIOR ART)
FIG. 1 illustrates schematically a prior art refrigeration system.
Figure 2:
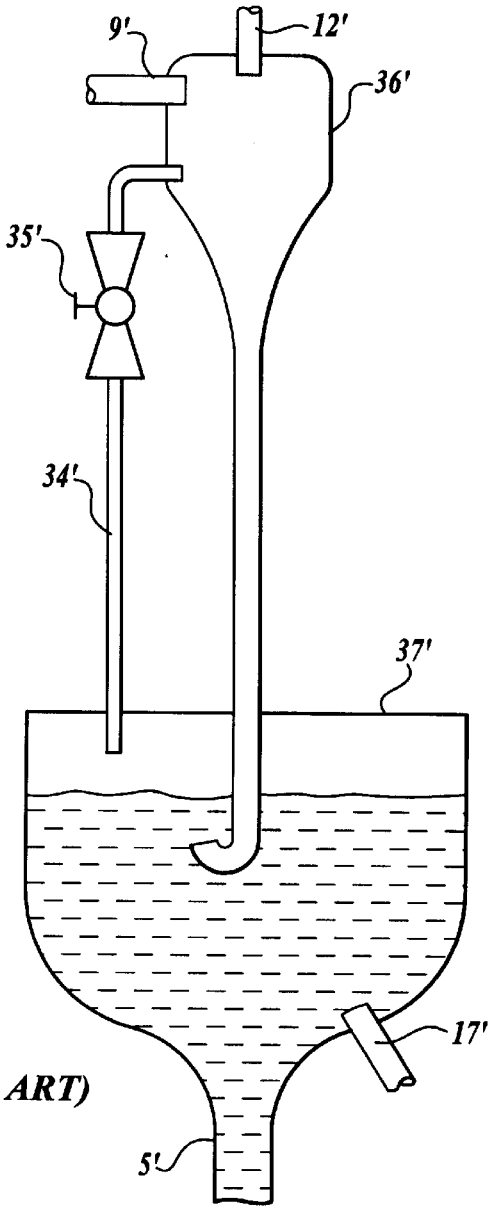
Fig.2. (PRIOR ART)
FIG. 2 illustrates an alternative embodiment of a separator for use with the prior art refrigeration system of FIG. 1.
Figure 4:
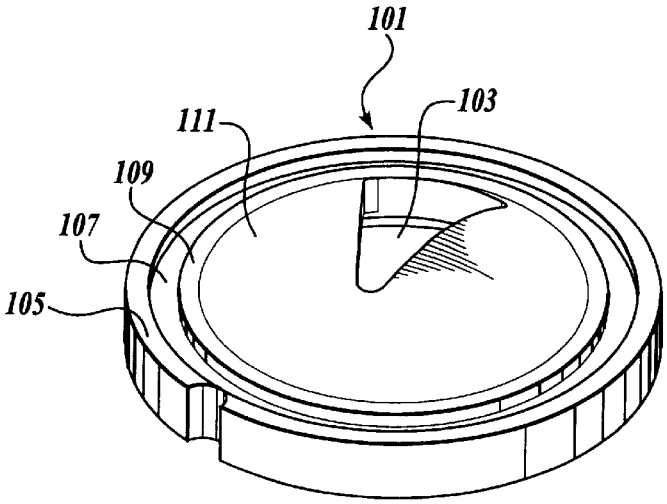
FIG. 4 illustrates a valve seat according to a further aspect of the present invention.

Referring to FIG. 4, a seat 101 for a ball valve, such as valve 18 may be, is shown. As is know in the art, ball valves consist of a valve body having a ball receiving cavity with aligned inlet and outlet passages leading to and from the cavity. A ball with an opening formed therethrough is rotatably supported in the cavity between the inlet and outlet passages. The ball is rotatable between an open position wherein the ball opening is aligned with the inlet and outlet passages, and a closed position where the opening is out of alignment with the inlet and outlet passages. A handle may be provided to manually rotate the ball. Sealing between the ball and the body is accomplished by two ring shaped seats located in the valve body on opposite sides (inlet and outlet) of the cavity for engagement with the ball and which have openings defining a portion of the inlet and outlet passages respectively. These seats each have sealing surfaces for engagement with the ball on one side and the valve body on the other.

Standard valves have an initial opening of the downstream side of the valve at the handle position of about 10% open. As the valve is being opened a pressure drop is created across the valve, which can cause the refrigerant to solidify and plug the valve and/or line. To address this problem the present invention provides a seat 101 positioned at the downstream side of the valve, that restricts flow until the valve 18 is open far enough to ensure that the pressure drop is taken at the downstream opening of the valve. In one embodiment the seat 101 allows flow only when the handle position of the valve 18 is at least about 20% open. It is also an option for the seat 101 to be a characterized seat, as is understood in the art, so that there is linearity between the position of the valve 18 handle and the valve opening size.

In one possible embodiment of this invention, seat 101 comprises a triangular shaped opening 103 across the seat's diameter. This opening can define an angle of about 30°, but other shaped openings can also be used. The seat comprises a ring shaped base comprising an outer ring 105 and an inner ring 109 connected by a depression 107. The base serves to seal the seat against the valve body. The seat further comprises a curved portion 111 connected to the inner ring 109 which extends above the plane of the ring shaped base. The curved portion 111 serves to seal the seat against the ball. The seat opening 103 is formed in the curved portion 111, allowing flow of refrigerant to pass through the seat 101 when valve 18 is opened.

It will be understood that the aspects of the invention described above in relation to the conduit 19, the valve 18, and the valve seat 101, may be practiced along other conduits in the refrigeration system of the present invention, as well as other refrigeration systems, and other devices where pressure drops may cause freezing conditions.

Direct Injection System

As noted above, in the present invention, liquid refrigerant is expanded during transfer to the intermediate slurry tank 37. This expansion may cause several problems. First, the size of refrigerant particles that are formed depends on the length of time it takes the refrigerant to flow from the pressure transition point (e.g. valve 18) to the intermediate slurry tank 37. The longer time this pressure transition exists, the larger the refrigerant particles become. For the present invention it is desirable to keep the refrigerant particles small to increase the surface area to mass ratio, for refrigeration efficiency as well as improved suspension in slurry. Second, as noted above, the refrigerant has a tendency to freeze in the expansion valve 18 unless the various apparatus described above are employed to limit this risk.

Figure 6:
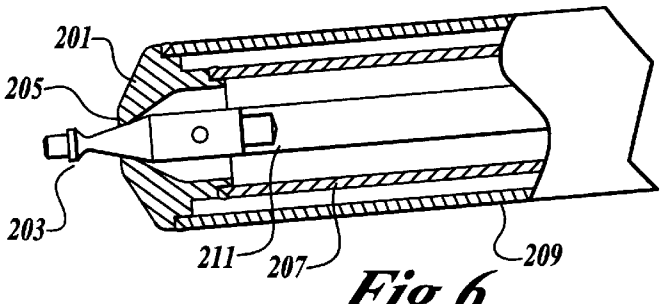
FIG. 6 illustrates a cross sectional view of the direct injection system according to a further aspect of the present invention.
Figure 5:
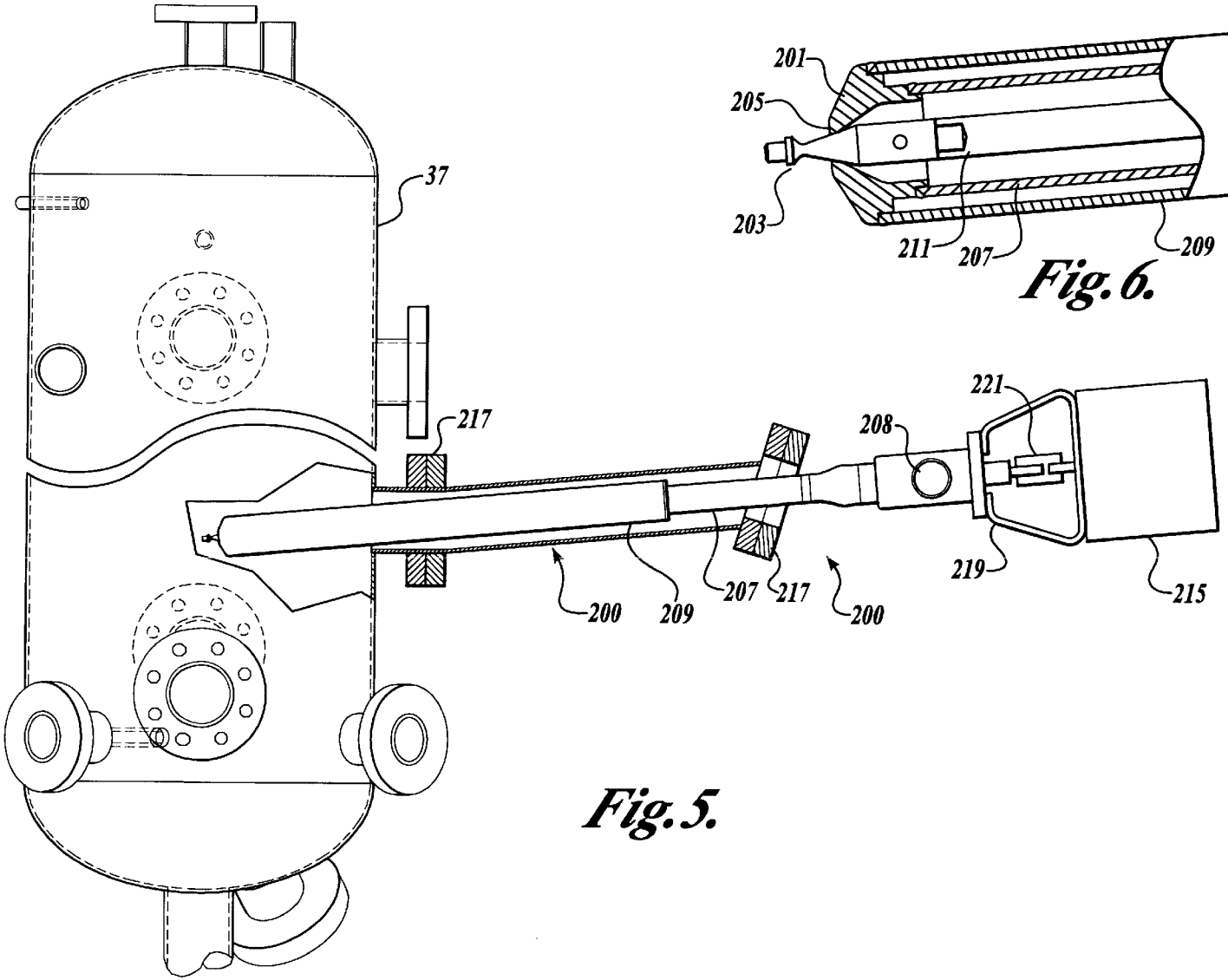
FIG. 5 illustrates a direct injection system according to a further aspect of the present invention.

Referring to FIGS. 5 and 6, in another aspect of the present invention, the liquid refrigerant supplied from the condenser receiving tank 16, may be directly injected into the intermediate slurry tank 37. This direct injection causes the pressure drop to occur within the intermediate slurry tank 37 and helps avoid the problems of too large refrigerant particles, as well as expansion valve 18 freezing. This could be accomplished by having no expansion in conduit 19. FIGS. 5 and 6 show a refrigerator direct injection system 200 for injecting a liquid refrigerant into the intermediate slurry tank 37. However, it will be understood that invention of the direct injection system 200 could be used for injecting any liquid or slurry into any container, where the liquid or slurry either exhibits a tendency to freeze within expansion valves or where particle growth tend to occur during a pressure drop.

In one embodiment, the direct injection system 200 comprises a needle valve seat 201, valve needle 203, inner pipe 207, and extended spindle 211. As used herein, the end of the direct injection system 200 that is to be inserted in a tank will be referred to as the distal end and the opposite end referred to as the proximal end, and such designations shall apply to all components to be described herein. The proximal end of inner pipe 207 has an inlet 208 for receiving refrigerant 17. At the distal end of direct injection system, the needle valve seat 201 is attached to the distal end of inner pipe 207. The valve seat has an opening or outlet 205, for outflow of refrigerant 17, through which the needle 203 may move. The needle 203 is specially shaped so that the needle 203 may seal outlet 205. When the needle 203 is moved with respect to the needle valve seat 201, the tapered portion of the needle 203 allows and controls the amount of flow through the outlet 205. In one embodiment, an outer pipe 209 may surround at least a proximal portion of inner pipe 207 and may form an insulation gap between the outer and inner pipes. In one embodiment, the insulation gap between the outer and inner pipes may contain air.

The needle 203 may be attached to the distal end of a spindle 211 which is disposed inside of inner pipe 207. The proximal end of spindle 211 sealably extends beyond the proximal end of inner pipe 207. In one embodiment a linear actuator 215 may be connected to the proximal end of inner pipe 207 by a housing 219. The linear actuator may also be connected to the spindle 211 by a connector 221. The linear actuator 215 may act on the connector 221 and spindle 211 to move the needle 203 with respect to outlet 205, starting or stopping flow of refrigerant. In one embodiment, the distal end of the direct injection system 200 may be placed into intermediate tank 37 through an intermediate slurry tank port 217.

Figure 7A:
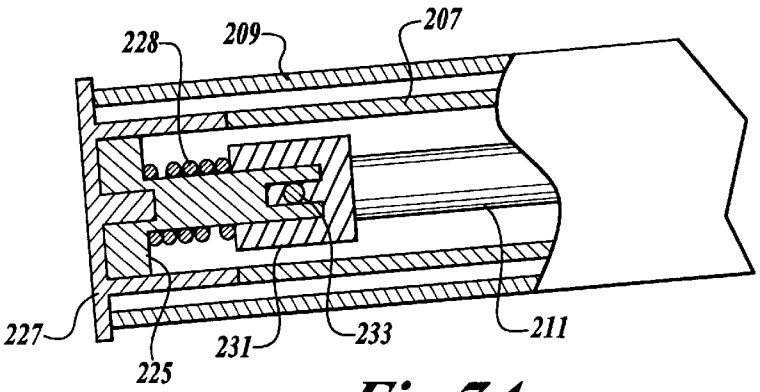
FIG. 7A illustrates a cross sectional view of an expansion nozzle head for use with the direct injection system according to a further aspect of the present invention.
Figure 7B:
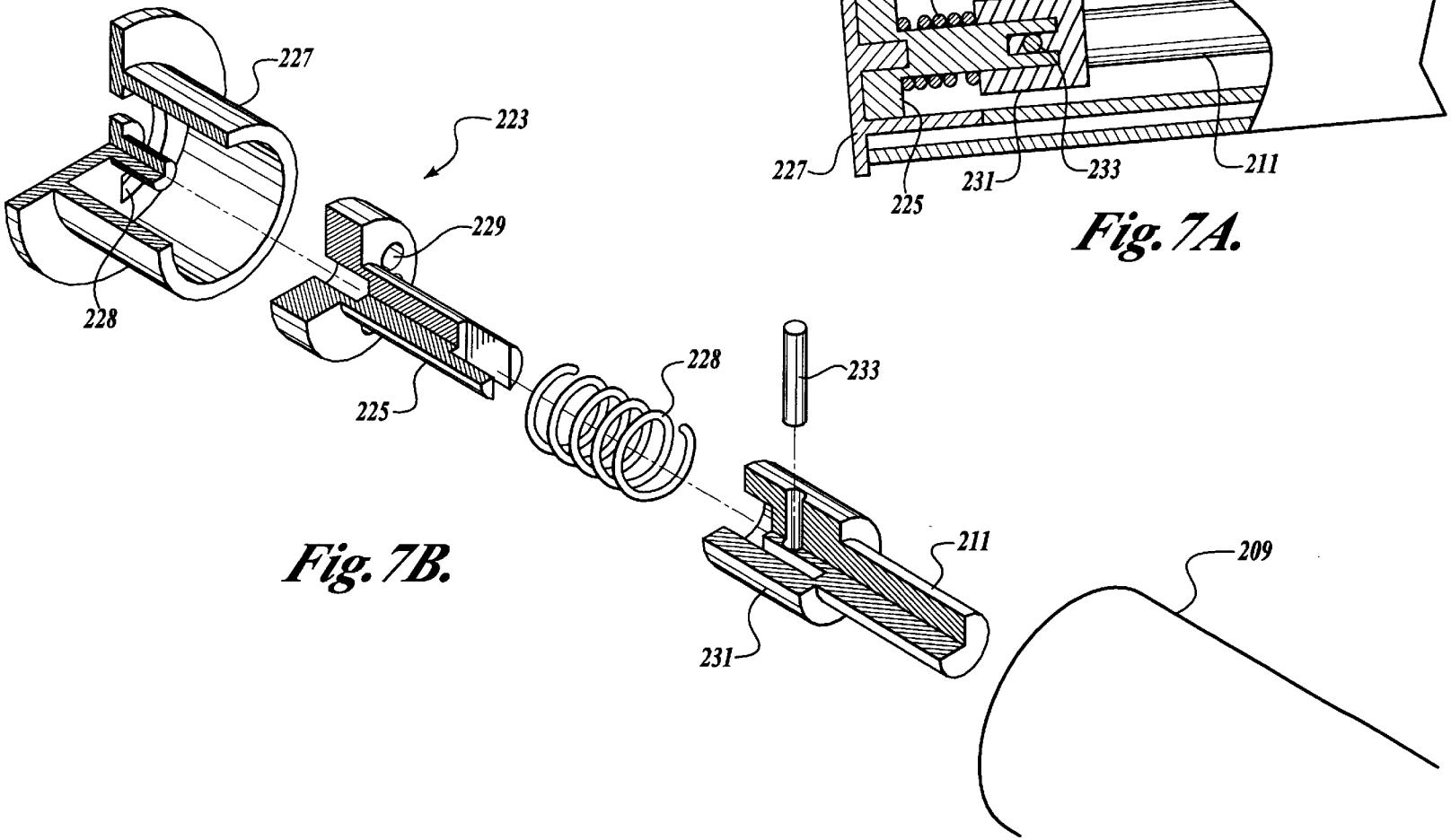
FIG. 7B illustrates a cross sectional exploded view of an expansion nozzle head for use with the direct injection system according to a further aspect of the present invention.

Referring to FIGS. 7A and 7B, in one embodiment, needle valve seat 201 and valve needle 203 may be replaced with an expansion valve head 223, which may be attached to the distal end of the direct injection system. The expansion valve head 223 may include a rotor 225 and expansion nozzle valve seat 227. The rotor 225 is positioned in face-to-face relationship with the expansion valve seat 227. The expansion valve seat 227 may have an arcuate-shaped expansion valve opening or outlet 228. The rotor 225 comprises openings such as holes 229, slot, or other shaped opening or openings. The linear actuator 215, used with the valve needle 203 above, may be replaced with a rotor actuator which can act on extended spindle 211 to rotate rotor 225 to vary the flow of refrigerant 17 from the direct injection system. The extended spindle 211 may be connected to rotor 225 by socket 231. Socket 231 may include a fastening cross pin 233. The illustrated pin 233 is insertable into a cross hole formed in the socket 231 to secure the rotor 225 to socket 231. In addition, a spring 226 may be placed about a stem portion of rotor 225 and compressed against the adjacent end face of socket 231 to provide a compression force between the rotor 225 and the nozzle valve seat 227. The compression force of the spring 226 may prevent or limit solids from building up between the rotor 225 and the nozzle valve seat 227. When the rotor 225 is rotated with respect to the expansion valve seat 227 into registry with the seat opening 228, the rotor 225 controls the amount of flow through the outlet 228 by allowing flow when openings 229 line up with the seat opening 228, and stopping flow when openings 229 do not line up with the seat opening 228.

In another embodiment of this invention, a trickle gas injection line may be added to the direct injection system. The trickle gas injection line discharges gas upstream from the injector orifice. Preferably the gas is the same substance as the refrigerant. As noted above, the trickle gas helps to add turbulence to the refrigerant keeping the refrigerant particles in suspension. In one embodiment the trickle feed gas may be supplied from the compression system 10 discharge.

In another embodiment of this invention, multiple direct injection systems may be connected to the intermediate slurry tank 37. In another embodiment, an array of direct injectors of various flow rates could be controlled with solenoid type valves, thus eliminate the need for variable control motorized valves to control the flow of refrigerant into the intermediate slurry tank 37.

At certain flow rates and pressures the direct injection system 200 may freeze. In one embodiment, control settings are set to prevent flow rate and pressure in the direct injection system 200 from reaching a freeze up point. The valve may be shut when freeze-up conditions are near. Additionally or alternatively, vapor flow to the compression system 10 may be continued to artificially load the compressor, and raise the pressure in the direct injection system.

Recirculation Line

Referring to FIGS. 8 and 9, in another aspect of the invention, a recycle line 60 may be connected to the conduit 30 to recycle slurry back to the main slurry tank 36 through inlet 61, forming a recirculation line. The inlet 61 may be tangential to the vertical curvature of the slurry tank wall. The inlet 61 may be formed by piping the recycle line 60 vertically through the bottom of slurry tank 36, rising for about six inches or so and then turning 90° to face generally horizontally tangential to the vertical curvature of the slurry tank wall. Another feature of this aspect of the present invention is that the inlet 60 may end in a pipe expansion 63, as shown in FIG. 9, to help prevent solids from settling. As is shown in FIGS. 8 and 9, more than one recirculation line may be used for the recirculation of slurry. When more than one recirculation line is employed, it is an option for the inlets to face complementary directions to thus impart a flow in the same direction. FIG. 8 shows the recycle line 60 connected to conduit 30 down stream of pump 43, however it will be understood that a recycle line could be placed downstream of any pump of any tank in the refrigeration system.

The recirculation line of the present invention helps prevent the settling of solid refrigerant particles and the clogging of the outer 31. For solids in a suspension, the settling rate is determined by the flow within the control boundary, whereas shear has little effect on the settling rate. The flow induced by the recirculation line may sweep solids off of the bottom of the main slurry tank and into suspension.

In one embodiment, a vortex breaking baffle 65 may also be positioned at the bottom of the slurry tank 36. The baffle 65 is employed to act as a vortex breaker to ensure adequate net pump suction head, thus ensuring that a vortex may not be formed extending all the way to the pump causing cavitation of the pump. In one embodiment, the baffle 65 may be a cross style vertical baffle formed of two intersecting vertical pieces, as is shown in FIGS. 8 and 9, and may be placed directly above the outlet.

The prior art of Strong describes agitating the bottoms of mixing tank 37' by feeding back slurry from conduit 4'. However, this description fails to note any of the improvements noted above, including multiple recirculation lines, the vortex breaking baffle 65, the inlet 60 ending in a pipe expansion, or that the recirculation line be piped vertically through the bottom of the tank and then turned 900 to face horizontally tangential to the vertical curvature of the tank wall.

Control System

Referring to FIG. 3, in another aspect of the invention, a control system 28 for could use the readings of a sensor 27, such as a photocell, passing light across the slurry flow in the first conduit 4, as a controlling input in order to regulate the flow rate of refrigerant supplied to the intermediate slurry tank 37. With the example sensor 27 being a photocell, the greater the concentration by mass of the refrigerant solids in suspension, the more light is absorbed, resulting in a higher reading. These readings can be used by the control system 28 to control the position of the valve 18 in the conduit 19 to control the flow of refrigerants into the intermediate slurry tank 37. Other readings could be used, such as temperature readings of the air in the refrigerator. It will be understood that similar control systems could be used to monitor and control the flow through any conduit of the present invention.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A refrigeration system comprising:

an intermediate slurry tank for a refrigerant vapor and a slurry of solid sublimatable refrigerant particles in a liquid having a first outlet for outflow of the slurry, a second outlet for outflow of the vapor, and a first inlet for receiving the refrigerant;

an evaporator having an inlet and an outlet;

a first conduit connecting the first outlet of the intermediate slurry tank and the evaporator inlet;

a compression system having a first low pressure inlet and second intermediate pressure inlet, and having a high pressure outlet;

a second conduit connecting the evaporator outlet and the first low pressure inlet of the compression system;

a third conduit connecting the second outlet of the intermediate slurry tank and the second intermediate pressure inlet of the compression system;

a condenser having a condenser inlet and a condenser outlet;

a fourth conduit connecting the compression system outlet and the condenser inlet;

a condenser receiving tank having an inlet for receiving refrigerant and an outlet for receiving refrigerant;

a fifth conduit connecting the condenser outlet and the condenser receiving tank inlet; and a sixth conduit connecting the condenser receiving tank outlet to the first inlet of the intermediate slurry tank.

2. A refrigeration system as claimed in claim 1, wherein the compression system is a two stage compression system, wherein the compression system two stage has an inter-stage pressure substantially equal to the pressure of the intermediate slurry tank.

3. A refrigeration system as claimed in claim 1, wherein the refrigerant vapor and the solid sublimatable refrigerant particles consist of carbon dioxide.

4. A refrigeration system as claimed in claim 1, wherein the liquid consists of d'limonene.

5. A refrigeration system as claimed in claim 1, wherein the intermediate slurry tank is maintained at or below the triple point for carbon dioxide.

6. A refrigeration system as claimed in claim 1, further comprising a valve, having an upstream valve opening and a down stream valve opening, the valve disposed in the sixth conduit disposed down steam of the condenser receiving tank outlet and disposed upstream of the first intermediate slurry tank inlet, wherein the valve drops the pressure of the refrigerant.

7. A refrigeration system as claimed in claim 6, further comprising a valve seat, for delaying the flow of refrigerant when the valve is moved from the closed to open positions, having a seat opening and disposed immediately adjacent to the upstream valve opening.

8. A refrigeration system as claimed in claim 7, wherein the seat opening allows flow through the valve when the valve handle has a rotational location of substantially equal to or greater than 20% open.

9. A refrigeration system as claimed in claim 8, wherein the seat opening is a characterizing seat providing linearity between the rotational position of the valve handle and the valve opening size, the seat having a triangular shaped port extending across a portion of the seat diameter.

10. A refrigeration system as claimed in claim 6, wherein the valve is placed closer to the intermediate slurry tank than the condenser receiving tank to reduce refrigerant particle size.

11. A refrigeration system as claimed in claim 6, wherein the sixth conduit, has an upward slope from the condenser receiving tank outlet to the valve.

12. A refrigeration system as claimed in claim 6, wherein the sixth conduit, has a downward slope from the valve to the first intermediate slurry tank inlet.

13. A refrigeration system as claimed in claim 6, further comprising a vapor trickle feed into the sixth conduit, to reduce the collection of solids in and around the valve.

14. A refrigeration system as claimed in claim 13, wherein the vapor trickle feed injects vapor carbon dioxide.

15. A refrigeration system as claimed in claim 6, further comprising a vapor de-plug feed into the sixth conduit, to remove collection of solids in and around the valve.

16. A refrigeration system as claimed in claim 15, wherein the vapor de-plug feed injects vapor carbon dioxide.

17. A refrigeration system as claimed in claim 1, further comprising a liquid injection system, having an injector opening located within the slurry tank and connected to the second intermediate slurry tank inlet.

18. A refrigeration system as claimed in claim 17, wherein the liquid injection system injects liquid carbon dioxide.

19. A refrigeration system as claimed in claim 17, wherein the injector opening receives a needle shaped valve.

20. A refrigeration system as claimed in claim 17, further comprising a trickle gas injection line disposed immediately upstream from the injector orifice.

21. A seat for a ball valve having a housing formed with a fluid passageway extending therethrough, a ball disposed within the housing and in registry with the fluid passage way and a handle for rotating the ball, said seat comprising:

a spheroid portion shaped to closely overlie a portion of the ball presented to the fluid passageway of the housing; opening formed in the spheroid portion of the seat; the opening shaped for allowing flow to initiate through a valve when a valve handle has a rotational location of equal to or greater than twenty percent open, and preventing flow through the valve when the valve handle is at a rotational location less than twenty percent open.

22. A seat as claimed in claim 21, wherein the seat is a characterizing seat providing linearity between the rotational open position of the valve handle and the valve opening size.

23. A seat as claimed in claim 22, wherein the seat has a triangular shaped opening extending across a portion of the seat diameter.

24. A refrigerator expansion line for a slurry of solid sublimatable particles in a liquid comprising:

a supply conduit;

an expansion valve in fluid flow communication with a down stream portion of the supply conduit;

a receptacle conduit in fluid flow communication with a down stream portion of the expansion valve;

a receptacle in fluid flow communication with a down stream portion of the receptacle conduit;

wherein the expansion valve drops the pressure of slurry flowing from the supply conduit to the receptacle conduit; and wherein a gas trickle feed into the supply conduit to reduce the collection of solids in and around the valve.

25. A refrigerator expansion line as claimed in claim 24, wherein the supply conduit has an upward slope.

26. A refrigerator expansion line as claimed in claim 24, wherein the receptacle conduit has a downward slope.

27. A refrigerator expansion line as claimed in claim 24, wherein the receptacle conduit is shorter in length than the supply conduit to reduce the particle size of slurry solids leaving the expansion valve while flowing through the receptacle conduit.

28. A refrigerator expansion line as claimed in claim 24, wherein the gas trickle feed comprises carbon dioxide.

29. A refrigerator expansion line as claimed in claim 24, further comprising a gas de-plug feed into supply conduit to remove the collection of solids in and around the valve.

30. A refrigerator expansion line as claimed in claim 29, wherein the gas deplug comprises carbon dioxide.

31. A refrigerator direct injection system for injecting a liquid into a slurry tank for a vapor and a slurry of solid sublimatable particles in a second liquid, comprising:

a valve seat with an opening;

a delivery line with an inlet and outlet, the inner pipe outlet connected to the valve seat;

a liquid feed source connected to the delivery line inlet;

a spindle received within the delivery line;

a valve member connected to the spindle;

wherein the spindle may move the valve member with respect to the valve seat for sealing or opening the valve seat opening; and wherein the valve seat opening is located inside the slurry tank.

32. A refrigerator direct injection system as claimed in claim 31, wherein the liquid injection system injects liquid carbon dioxide.

33. A refrigerator direct injection system as claimed in claim 31, further comprising a trickle gas injection line, discharging immediately upstream from the injector orifice.

34. A refrigerator direct injection system as claimed in claim 31, further comprising at least a second direct injection valve connected to at least a second slurry tank port.

35. A refrigerator direct injection system as claimed in claim 31, wherein the valve member is a needle valve.

36. A refrigerator direct injection system as claimed in claim 31, wherein the valve member is a rotor for an expansion valve head.

37. A refrigeration recirculation line comprising:

a slurry tank, for a vapor and a slurry of solid sublimatable particles in a liquid, having an inlet and an outlet;

a first conduit connected to the slurry tank outlet;

a recycle line connected to the first conduit and to the slurry tank inlet, wherein the slurry tank inlet is tangential to the vertical curvature of the slurry tank wall; and a vortex breaking baffle positioned at the bottom of the slurry tank and above the slurry tank inlet.

38. A refrigeration recirculation line as claimed in claim 37, wherein the slurry tank inlet induces counter clockwise flow in the slurry tank, as viewed from above.

39. A refrigeration recirculation line as claimed in claim 37, wherein the slurry tank inlet ends in an expansion.

40. A refrigeration system comprising:

an intermediate slurry tank for receiving and storing a refrigerant vapor and a slurry of solid sublimatable refrigerant particles in a liquid having a first outlet for outflow of the slurry, a second outlet for outflow of the vapor, and a first inlet for receiving the refrigerant;

an evaporator having an evaporator inlet and an evaporator outlet;

a first conduit connecting the first outlet of the intermediate slurry tank and the evaporator inlet;

a main slurry tank for receiving and storing a refrigerant vapor and at least the liquid having an outlet and an inlet;

a second conduit connecting the evaporator outlet and the main slurry tank inlet;

a compression system having a first low pressure inlet and second intermediate pressure inlet, and having a high pressure outlet;

a third conduit connecting the main slurry tank outlet and the first low pressure compression system inlet;

a condenser having a condenser inlet and a condenser outlet;

a fourth conduit connecting the compression system outlet and the condenser inlet;

an fifth conduit connecting the condenser outlet and the first inlet of the intermediate tank; and a sixth conduit connecting the second outlet of the intermediate slurry tank and the second intermediate pressure inlet of the compression system.

41. A refrigeration system comprising:

an intermediate slurry tank for receiving and storing a refrigerant vapor and a slurry of solid sublimatable refrigerant particles in a liquid having a first outlet for outflow of the slurry within the slurry tank, a second outlet for outflow of the refrigerant vapor in the tank, a first inlet for receiving at least the liquid, and a second inlet for receiving the refrigerant;

an evaporator having an inlet and an outlet;

a first conduit connecting the first outlet of the intermediate slurry tank and the evaporator inlet;

a main slurry tank for receiving and storing at least the refrigerant vapor and the liquid, having a first outlet for outflow of at least the liquid, a second outlet for outflow of the refrigerant vapor, and an inlet;

a second conduit connecting the evaporator outlet and the main slurry tank inlet;

a third conduit connecting the first outlet of the main slurry tank with the first inlet of the intermediate slurry tank;

a compression system having a first low pressure inlet and second intermediate pressure inlet, and having a high pressure outlet;

a fourth conduit connecting the second outlet of the main slurry tank and the low pressure inlet of the compression system;

a fifth conduit connecting the second outlet of the intermediate slurry tank and the intermediate pressure inlet of the compression system;

a condenser having a condenser inlet and a condenser outlet;

a sixth conduit connecting the compression system outlet and the condenser inlet;

a condenser receiving tank having an inlet for receiving refrigerant and an outlet for outflow of refrigerant;

a seventh conduit connecting the condenser outlet and the condenser receiving tank inlet; and an eighth conduit connecting the condenser receiving tank outlet to the second intermediate slurry tank inlet.

42. A refrigeration system as claimed in claim 41, wherein the compression system is a two stage compression system, wherein the two stage compression system has an inter-stage pressure substantially equal to the pressure of the intermediate slurry tank.

43. A refrigeration system as claimed in claim 41, wherein the solid sublimatable refrigerant particles consist of carbon dioxide.

44. A refrigeration system as claimed in claim 41, wherein the liquid consists of d'limonene.

45. A refrigeration system as claimed in claim 41, wherein the vapor consists of carbon dioxide.

46. A refrigeration system as claimed in claim 41, wherein the intermediate slurry tank is maintained at or below the triple point for carbon dioxide.

47. A refrigeration system as claimed in claim 41, wherein the intermediate slurry tank has a greater volume than the main slurry tank.

48. A refrigeration system as claimed in claim 41, further comprising a pump having an inlet and an outlet, disposed in the third conduit.

49. A refrigeration system as claimed in claim 48, further comprising a frequency inverter for controlling the pump, wherein the frequency inverter controls the level of slurry in the main slurry tank.

50. A refrigeration system as claimed in claim 41, further comprising a valve, having an upstream valve opening and a down stream valve opening, the valve disposed in the eighth conduit disposed down steam of the condenser receiving tank outlet and disposed upstream of the second intermediate slurry tank inlet.

51. A refrigeration system as claimed in claim 50, wherein the valve drops the pressure of the slurry.

52. A refrigeration system as claimed in claim 50, further comprising a valve seat, for delaying the flow of slurry when the valve is moved from the closed to open positions, having a seat opening and disposed immediately adjacent to the upstream valve opening.

53. A refrigeration system as claimed in claim 52, wherein the seat opening allows flow through the valve when the valve handle has a rotational location of substantially equal to or greater than 20% open.

54. A refrigeration system as claimed in claim 53, wherein the seat opening is a characterizing seat providing linearity between the rotational position of the valve handle and the valve opening size, the seat having a triangular shaped port extending across a portion of the seat diameter.

55. A refrigeration system as claimed in claim 50, wherein the valve is placed closer to the intermediate slurry tank than the condenser receiving tank to reduce solid carbon dioxide particle size.

56. A refrigeration system as claimed in claim 50, wherein the eighth conduit, has an upward slope from the condenser receiving tank outlet to the valve.

57. A refrigeration system as claimed in claim 50, wherein the eighth conduit, has a downward slope from the valve to the second intermediate slurry tank inlet.

58. A refrigeration system as claimed in claim 50, further comprising a vapor trickle feed into the eighth conduit, to reduce the collection of solids in and around the valve.

59. A refrigeration system as claimed in claim 58, wherein the vapor trickle feed injects vapor carbon dioxide.

60. A refrigeration system as claimed in claim 50, further comprising a vapor de-plug feed into the eighth conduit, to remove collection of solids in and around the valve.

61. A refrigeration system as claimed in claim 60, wherein the vapor de-plug feed injects vapor carbon dioxide.

62. A refrigeration system as claimed in claim 41, further comprising a liquid injection system, having an injector opening located within the slurry tank and connected to the second intermediate slurry tank inlet.

63. A refrigeration system as claimed in claim 62, wherein the liquid injection system injects liquid carbon dioxide.

64. A refrigeration system as claimed in claim 62, wherein the injector opening receives a needle shaped valve.

65. A refrigeration system as claimed in claim 62, further comprising a trickle gas injection line disposed immediately upstream from the injector orifice.

66. A refrigeration system as claimed in claim 41, further comprising at least a second main slurry tank inlet and a recirculation line connected to the third conduit and connected to at least the second main slurry tank inlet.

67. A refrigeration system as claimed in claim 66, wherein at least the second main slurry tank inlet is tangential to the curvature of the vertical main slurry tank wall, and the main slurry tank has a vortex breaking baffle positioned at the bottom of the main slurry tank and above the second main slurry tank inlet.

68. A refrigeration system as claimed in claim 66, wherein at least the second main slurry tank inlet induces counter clockwise flow in the main slurry tank, as viewed from above.

69. A refrigeration system as claimed in claim 66,wherein at least the second main slurry tank inlet ends in an expansion.

70. In a refrigeration system for use with a slurry of solid sublimatable particles in a liquid having a mixing tank with a first outlet, a first inlet, and a second inlet; an evaporator with an inlet and an outlet; a first conduit connecting the first mixing tank outlet to the inlet of the evaporator; a separator with a first inlet, first outlet, and second outlet; a second conduit connecting the evaporator outlet to the first separator inlet; the separator discharging directly to the mixing tank by the shared opening of the first separator outlet and the first mixing tank inlet; a compressor with an inlet and an outlet; a third conduit connecting the second outlet of the separator to the compressor inlet; a condenser having an inlet and outlet; a fourth conduit connecting the compressor outlet and the condenser inlet; a receiver having an inlet and outlet; a fifth conduit connecting the condenser outlet to the receiver inlet; a sixth conduit connecting the receiver outlet to the second inlet of the mixing tank; wherein the improvement comprises:

the mixing tank having a second outlet for outlet of refrigerant vapor;

the compressor having an intermediate pressure inlet for receiving refrigerant vapor; and an intermediate pressure conduit line connecting the second mixing tank outlet and the intermediate pressure compressor inlet.

* * * * *

UNITED STATES PATENT AND TRADEMARK OFFICE

CERTIFICATE OF CORRECTION

PATENT NO. : 6,516,626 B2
DATED : February 11, 2003
INVENTOR(S) : J.G. Escobar et al.

It is certified that error appears in the above-identified patent and that said Letters Patent is hereby corrected as shown below:

Title page,
Item [56], References Cited, U.S. PATENT DOCUMENTS, delete "5,960,411 A 9/1999 Hartman"

Column 1,
Line 7, "More particularly" should read -- More particularly, --
Line 16, "Strong, discloses" should read -- Strong discloses --
Line 28, "separator 36'," should read -- a separator 36', --
Line 28, "compressor" should read -- a compressor --
Line 40, "transfers" should read -- transfer --
Line 51, "is the energy" should read -- is that the energy --

Column 2,
Line 4, "from evaporator." should read -- from the evaporator. --
Line 9, "and send" should read -- and sends --
Line 19, "in intermediate" should read -- in the intermediate --

Column 3,
Line 10, "practices" should read -- practiced --
Line 17, "specification are" should read -- specification is --

Column 4,
Line 4, "d'limonene, the" should read -- d'limonene; and the --
Line 21, "and send it" should read -- and sends it --
Line 25, before "maintained at" insert -- be --
Line 55, "Further" should read -- Further, --

Column 5,
Line 18, "Alternatively" should read -- Alternatively, --
Line 43, "Expansion Conduit" should be indented and boldfaced Column 6,
Line 29, "Expansion Valve Seat" should be indented and boldfaced
Line 31, "As is know" should read -- As is known --
Line 44, "outlet passages" should read -- outlet passages, --
Line 50, "is being opened" should read -- is being opened, --
Line 54, "valve, that" should read -- valve that --

Column 7,
Line 14, "Direct Injection System" should be indented and boldfaced
Line 31, "16, may" should read -- 16 may --
Line 41, "container, where" should read -- container where --
Line 43, "growth tend" should read -- growth tends --

UNITED STATES PATENT AND TRADEMARK OFFICE

CERTIFICATE OF CORRECTION

PATENT NO. : 6,516,626 B2
DATED : February 11, 2003
INVENTOR(S) : J.G. Escobar et al.

It is certified that error appears in the above-identified patent and that said Letters Patent is hereby corrected as shown below:

Column 7 (cont'd),
Line 53, "end of direct" should read -- end of the direct --

Column 8,
Line 21, "229, slot" should read -- 229, a slot --
Line 46, "Preferably" should read -- Preferably, --
Line 48, "refrigerant keeping" should read -- refrigerant, keeping --
Line 56, "thus eliminate" should read -- thus eliminating --

Column 9,
Line 1, "Recirculation Line" should be indented and boldfaced
Line 18, "43, however" should read -- 43; however, --
Line 24, "outer 31." should read -- outlet 31. --
Line 44, "900" should read -- 90° --
Line 47, "Control System" should be indented and boldfaced
Line 49, "28 for could" should read -- 28 could --

Column 10,
Line 66, before "the condenser" insert -- to --

Column 11,
Lines 2 and 5, "conduit, has" should read -- conduit has --
Line 13, "remove collection" should read -- remove the collection --
Line 29, "passage way" should read -- passageway --
Line 33, "housing; opening" should read -- housing opening --
Line 49, "liquid comprising" should read -- liquid, comprising --

Column 12,
Line 7, "into supply" should read -- into the supply --
Line 9, "deplug" should read -- de-plug --
Line 51, "counter clockwise" should read -- counterclockwise --

Column 14,
Line 21, "eighth conduit" should read -- eighth conduit, --
Line 42, before "the condenser" insert -- to --
Lines 45 and 48, "eighth conduit, has" should read -- eighth conduit has --
Line 57, "remove collection" should read -- remove the collection --

UNITED STATES PATENT AND TRADEMARK OFFICE

CERTIFICATE OF CORRECTION

PATENT NO. : 6,516,626 B2
DATED : February 11, 2003
INVENTOR(S) : J.G. Escobar et al.

It is certified that error appears in the above-identified patent and that said Letters Patent is hereby corrected as shown below:

Column 15,
Lines 15-16, "counter
clockwise" should read -- counter-clockwise --
Line 18, "66,wherein" should read -- 66, wherein --

Signed and Sealed this

Twenty-eighth Day of October, 2003

JAMES E. ROGAN
*Director of the United States Patent and Trademark Office*